United States Patent [19]

Roberts

[11] 4,195,503

[45] Apr. 1, 1980

[54] ROTARY DISC-TUMBLER LOCK CYLINDER

[76] Inventor: Marvin E. Roberts, 2305 S. Arlington, Reno, Nev. 89502

[21] Appl. No.: 871,549

[22] Filed: Jan. 23, 1978

[51] Int. Cl.[2] ..... E05B 27/00

[52] U.S. Cl. ..... 70/366; 70/367; 70/371; 70/372

[58] Field of Search ..... 70/366, 365, 373, 375, 70/377, 371, 369, 368, 367, 376, 370, 372

[56] References Cited

U.S. PATENT DOCUMENTS

| | | | |
|---|---|---|---|
| 3,399,555 | 9/1968 | Gray | 70/369 |
| 3,789,638 | 2/1974 | Roberts | 70/366 |
| 3,848,442 | 11/1974 | Mertanen | 70/366 |

FOREIGN PATENT DOCUMENTS

| | | | |
|---|---|---|---|
| 752937 | of 1965 | France | 70/369 |
| 74585 | 5/1954 | Netherlands | 70/366 |
| 115282 | 10/1945 | Sweden | 70/366 |

*Primary Examiner*—Robert L. Wolfe

[57] ABSTRACT

A lock cylinder incorporating a front retainer for a sidebar and a body counterbore to receive same, a core shell having a torquing engagement extension and an indexing protrusion to properly index the insertion and removal of the core, a torquing tumbler for applying rotational torque to the core, an improved centering spring, an inter-connection of a sidebar and a body engaging link of a removable core differential mechanism, a method of yieldingly biasing the engaging links outwardly from the core assembly, and improved combinating capabilities by arrangements of gatings in the rotary disc-tumblers for variable incrementations and the arrangement of tumblers and spacers of various thicknesses to achieve a variable spacings of the bittings.

33 Claims, 24 Drawing Figures

ROTARY DISC-TUMBLER LOCK CYLINDER

BACKGROUND OF THE INVENTION

This invention pertains to a cylindrical lock cylinder with a rotary plug or core operated by a key or other device. The cylinder incorporates rotary disc-tumblers placed transversely thereof, a removable core capability, a tumbler centering spring, a torque tumbler, a core shell having a torque contact extension and an indexing protrusion, and other operating elements, parts and adjuncts.

A type of rotary disc-tumbler cylinder such as manufactured under the trade name Abloy by AB Wartsila OY of Helsinki, Finland has a history of greatly improved security especially from surreptitious entry methods. These cylinders, however, due to their generally unidirectional operation using a single key, lack a facility for ready interchangability into locksets and other lock boltwork commonly used in much of the world.

The cylinder in U.S. Pat. No. 3,789,638, Roberts et al, discloses a rotary disc-tumbler lock cylinder with a bi-directional operating capability using a single key while maintaining a high degree of security against surreptitious entry means. This invention also disclosed one method of incorporating a removable core mechanism in a rotary disc-tumbler lock cylinder. U.S. Pat. No. 3,905,213, Roberts, disclosed another method of achieving a removable core feature in a lock cylinder. In U.S. Pat. No. 2,690,070, Spain, a generally flat wire formed centering spring is disclosed.

The subject invention incorporates improvements in some of the elements of these references and discloses other improvements in the drawings and specifications hereof.

SUMMARY OF THE INVENTION

In general there is provided herein improvements in a rotary disc-tumbler lock cylinder to increase security against surreptitious entry methods, to simplify the manufacture and service of the cylinder, to reduce the cost thereof, to increase the operational life thereof, and to simplify the operation thereof including:

A cylinder body construction adapted to receive and position a front sidebar retainer.

A front sidebar retainer to maintain the sidebar in assembly with a removable core and to maintain a key inserted in the core assembly when out of the cylinder body.

A core shell torquing element with contacting surfaces for clockwise and counterclockwise rotation of the core assembly in the cylinder body.

A torque tumbler to properly time and efficiently transmit key rotation torque to the core shell.

A core shell indexing protrusion to simplify the insertion and removal of the coreshell and to preserve timing in a lockset by polarizing the core in relation to the cylinder body.

A centering spring construction to facilitate manufacture and to provide increased biasing force.

Tumbler gate incrementation arrangements to increase combinating possibilities and to vary combinating systems as between cylinders.

Tumbler width variations to vary spacings of combinating positions to increase combinating possibilities and to vary combinating systems as between cylinders.

Spacer width variations to vary spacings of combinating positions to increase combinating possibilities and to vary combinating systems as between cylinders.

An inter-connection of a sidebar and a removable core differential mechanism engaging link wherein a sidebar in conjunction with a body locking groove cams the engaging link out of engagement with the body during normal rotational unlocking of the core assembly, to permit the outward bias of the engaging link to outwardly bias the sidebar, and to retain the sidebar in assembly with the core assembly.

Beveled or rounded edges on the rear leading edge of engaging links to cam them inwardly during insertion of the core assembly into the cylinder body.

The transmission of outward linear bias to the engaging links of a removable core differential mechanism by the application of torsional bias to the cooperating link retractor.

The foregoing and other areas and objects of the invention will become more readily evident from the following detailed description of a preferred embodiment when considered in conjunction with the accompanying drawings.

DESCRIPTION OF A PREFERRED EMBODIMENT

Figure 1:
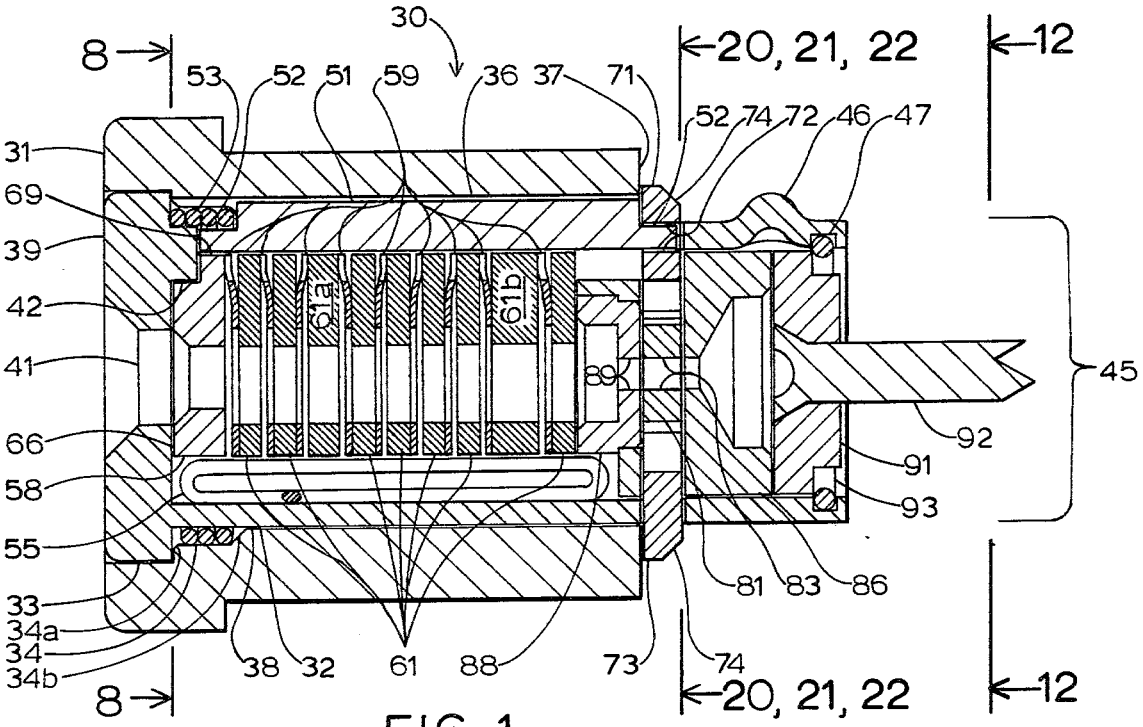
FIG. 1 is a cross section on a vertical axial plane through a lock cylinder according to the invention.

Referring to FIG. 1, a lock cylinder 30 of the type, for example, used in key-in-knob locksets, mortise locksets and others, having a body 31 with a generally circular cylindrical opening 32 therethrough, counterbore 34 and ramped transitions 34*a*, 34*b* at the front and rear respectively of counterbore 34, recess 33 in the face of body 31, locking groove 36 extending longitudinally along the interior of body 31, and body rear wall 37. A core assembly 45 within body 31 comprising a core shell 38, sidebar locking element 51, sidebar front retainer 53, a centering spring 55, rotary disc-tumblers 61, 61*a*, 61*b*, spacer elements 59, torque tumbler 66, removable core differential mechanism cage 86, spinner 88, top link 71, bottom link 73, link retractor 81, driver disc 91, driver bar 92, and retaining ring 93.

The exterior configuration of body 31 may vary to satisfy the requirements of some applications. Recess 33 may be omitted in some applications. Driver disc 91, driver bar 92, and retaining ring 93 may also be omitted in some applications. Engaging links 71, 73 may engage body 31 in an annular groove formed internally of body 31 as an alternate to engaging body rear wall 37 as shown in FIG. 1.

Figure 11:
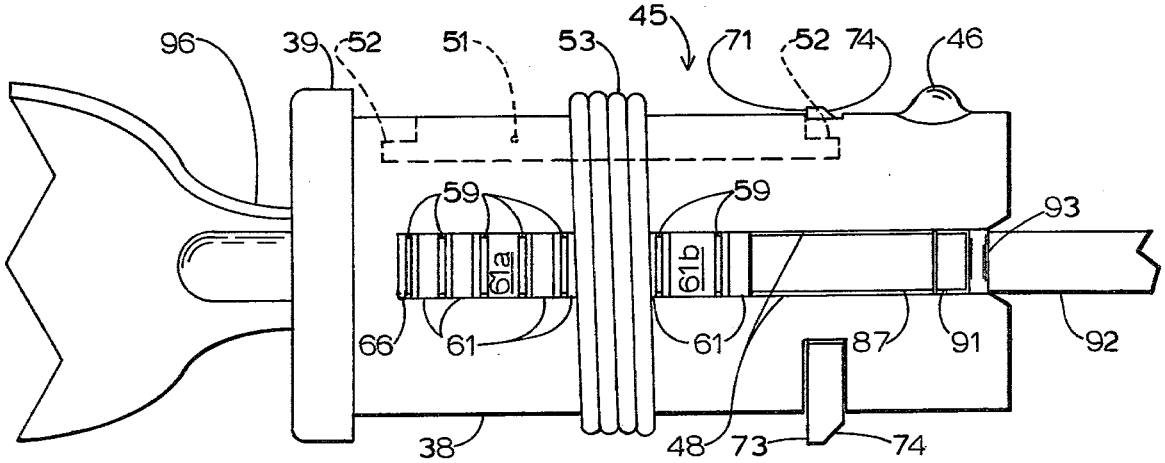
FIG. 11 is a side view of a core assembly removed from the cylinder body.

Front sidebar retainer 53 being radially inwardly biased when encircling core assembly 45 is slideably positionably along core assembly 45 when it is out of body 31. FIG. 11 shows core assembly 45 out of body 31 with retainer 53 holding sidebar 51 in an unlocked position flush with the surface of core assembly 45 after an unlocking combination has been achieved by rotation of a correspondingly coded key 96 and sidebar 51 having been depressed. In this condition key 96 is trapped in core assembly 45 thereby providing a convenient co-storage method.

Body counterbore 34 provides a space for front sidebar retainer 53 with core assembly 45 fully inserted into body 31. Transitions 34*a*, 34*b* cam links 71, 73 chordally inwardly during insertion of core assembly 45 into body 31. Transition 34*b* engages and slides front sidebar retainer 53 forward during insertion of core assembly 45 into body 31 when front sidebar retainer is in a position as in FIG. 11.

Figure 9:
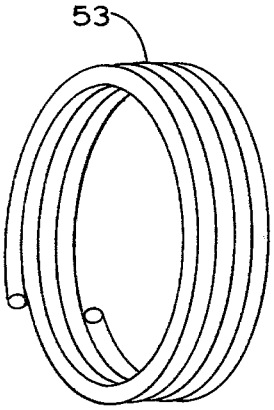
FIG. 9 is an isometric view of a front sidebar retainer.
Figure 10:
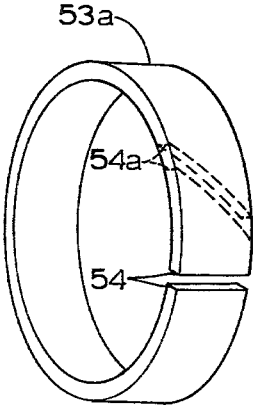
FIG. 10 is an isometric view of a front sidebar retainer of an alternate construction.

FIG. 9 shows one type of front sidebar retainer 53 while FIG. 10 shows an alternate type of front sidebar retainer 53*a*. Front sidebar retainer 53*a* may be formed, as for example, with slot 54 or, as shown in phantom, slot 54*a*.

Figure 12:
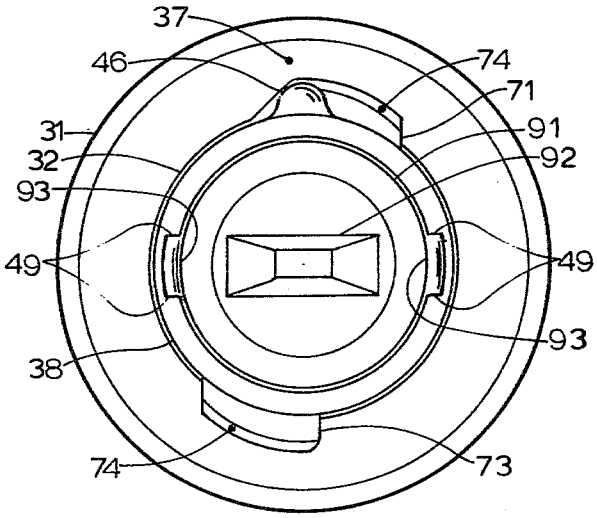
FIG. 12 is an end view taken along lines 12, 12 of FIG. 1.

Core shell 38 is formed with a front face or flange 39 having a centrally located keyhole 41 therethrough, a torquing extension 42, an indexing protrusion 46 located near the end of core shell 38 opposite flange 39, open longitudinal slots 48 or internal longitudinal grooves 49 as best seen in FIG. 12 serving to retain spacer elements 59 and other parts in fixed rotational alignment with core shell 38, and retaining ring groove 47 optionally provided internally near the open end of core shell 38.

Figure 8:
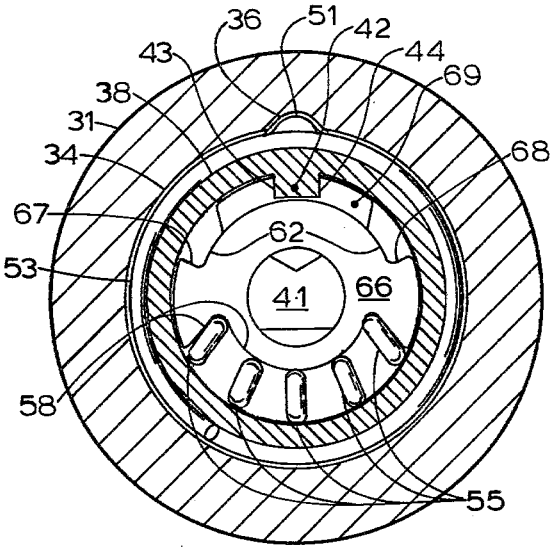
FIG. 8 is a cross sectional view taken along lines 8, 8 of FIG. 1.

Referring to FIG. 8, core shell torquing extension 42 has contact surfaces 43, 44. Torque tumbler 66 being formed with a centrally located keyhole 41, a centering spring recess 58, gatings 62 shown angularly disposed from sidebar 51 in the normally locked condition of cylinder 30, blocking portion 69 serving to block the radially inward movement of sidebar 51 in the normally locked condition, and drive surfaces 67, 68. Torque tumbler 66 being selectively rotated in a clockwise or counterclockwise direction by rotation of key 96 in keyhole 41 rotates either drive surfaces 67 or 68 into confronting relationship with either contact surface 43 or 44 respectively with continued key rotation rotating core shell 38 and associated core assembly 45 in the selected direction.

Referring to FIG. 1 and FIG. 11, indexing protrusion 46 is formed so as to pass through body 31 by extending into locking groove 36 during insertion and removal of core assembly 45. Indexing protrusion 46 is positioned longitudinally on core shell 38 in line with sidebar 51 and to be to the rear of body rear wall 37 with core assembly fully inserted into body 31 or alternately, indexing protrusion 46 is aligned with an annular groove formed in the interior of body opening 32 when body rear wall 37 extends beyond indexing protrusion 46 with core assembly 45 fully inserted into body 31.

Figure 2:
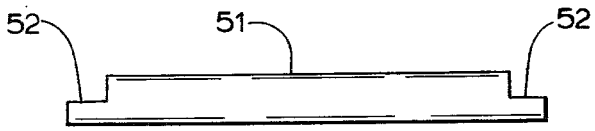
FIG. 2 is a sideview of a sidebar locking element.
Figures 3, 4, 5, 6, 7:
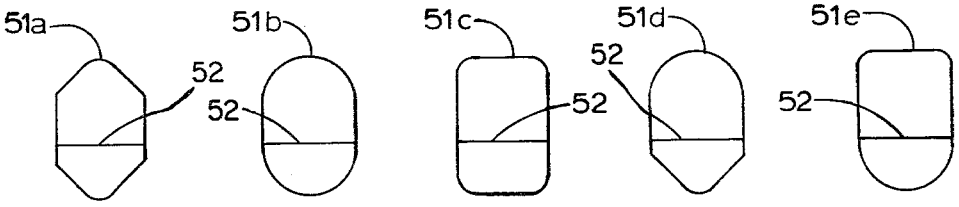
FIG. 3 through FIG. 7 are end views of sidebar locking elements each with a differing cross section.

Referring to FIG. 2, sidebar 51 is formed on each end thereof with an inter-connecting extension 52. Sidebars 51*a* through 51*e* of FIGS. 3 through 7 each have a different cross sectional configuration one from the other.

Referring to FIGS. 1, 20, 21 and 22, top engaging link 71 is formed with inter-connecting notch 72 into which either one of inter-connecting sidebar extensions 52 is located in core assembly 45 thus retaining sidebar 51 in assembly with core assembly 45.

Figure 21:
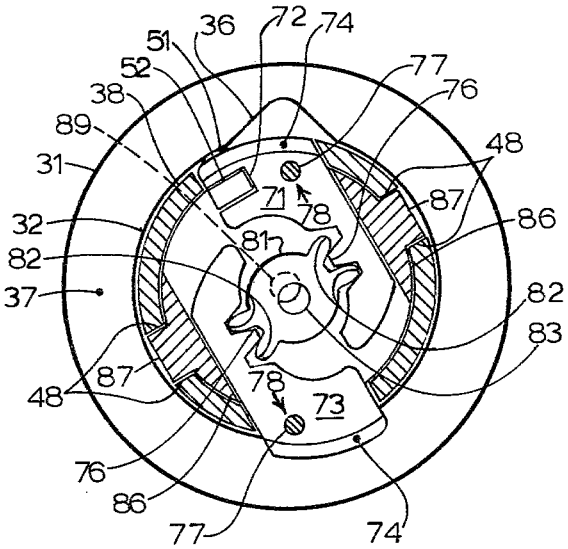
FIG. 21 is a cross sectional view taken along lines 21, 21 of FIG. 1 showing a removable core differential mechanism in an unlocked cylinder with a portion of the mechanism engaged to prevent removal of the core.

Referring to FIG. 21, links 71, 73 are biased chordally outwardly of cage 86 and core shell 38 by yielding linear bias in the direction of arrow 78 acting on pins 77 attached to links 71, 73. Sidebar inter-connecting extension 52 being radially entrapped within inter-connecting notch 72, sidebar 51 is yieldingly biased outwardly by bias 78 of link 71. Sidebar 51, being cammed radially inwardly of core assembly 45 by locking groove 36 during unlocking rotation of core assembly 45 in body 31 cams link 71 inwardly by reason of the inter-connection of extension 52 and notch 72. Links 71, 73 are optionally formed on the outer rear circumference thereof with a bevel or rounded edge 74 serving to cam links 71, 73 inwardly during insertion of core assembly 45 into body 31.

Figure 20:
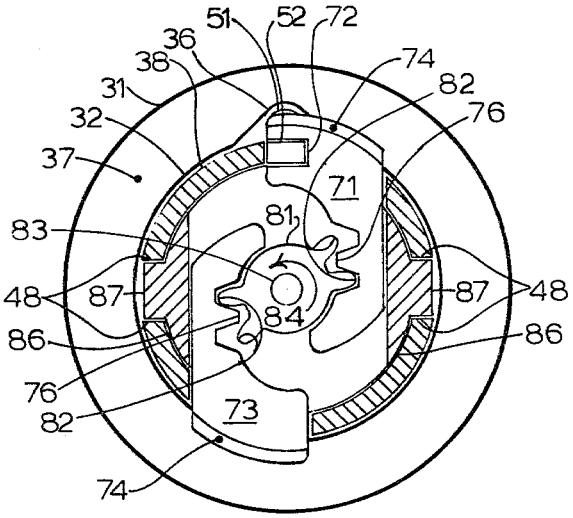
FIG. 20 is a cross sectional view taken along lines 20, 20 of FIG. 1 showing a removable core differential mechanism with the cylinder in a locked condition.
Figure 23:
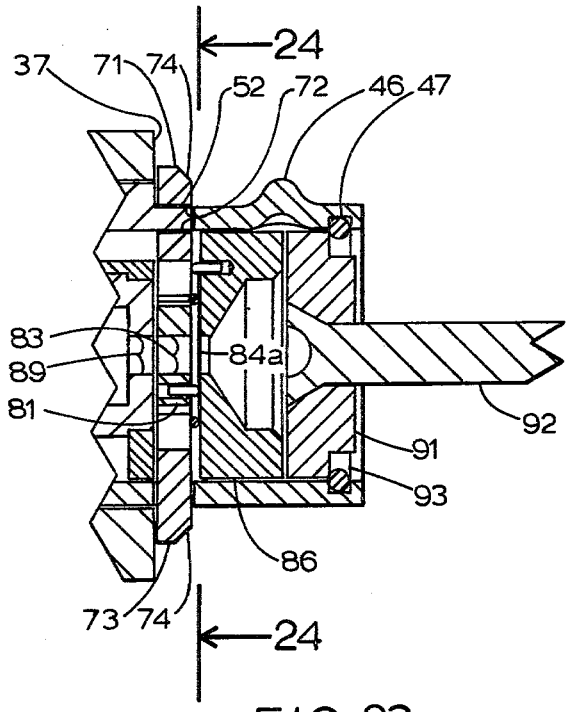
FIG. 23 is a cross sectional view taken on a vertical axial plane through the rear portion of the lock cylinder with portions of the cylinder being broken away to reduce the size of the drawing.
Figure 24:
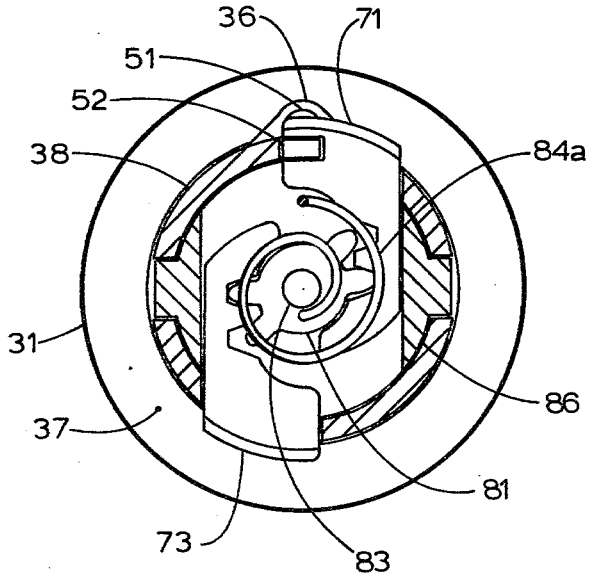
FIG. 24 is a cross sectional view taken along lines 24, 24 of FIG. 23.

Referring to FIG. 20, links 71, 73 are each formed with tooth 76 and retractor 81 is formed with teeth 82 cooperating with teeth 76 of links 71, 73 in assembly within cage 86. An alternate method of achieving outward yielding linear bias of links 71, 73 is to apply yielding torsional bias such as by means of torsional spring 84*a* as shown in FIGS. 23 and 24, in the direction of arrow 84 on retractor 81 which transmits torsional bias 84 through teeth 82 cooperating with teeth 76 into yielding outward linear bias of links 71, 73. Cage 86 is in fixed rotational alignment with core shell 38 by reason of cage side portions 87 being engaged in core shell slots 48 or grooves 49.

Figure 22:
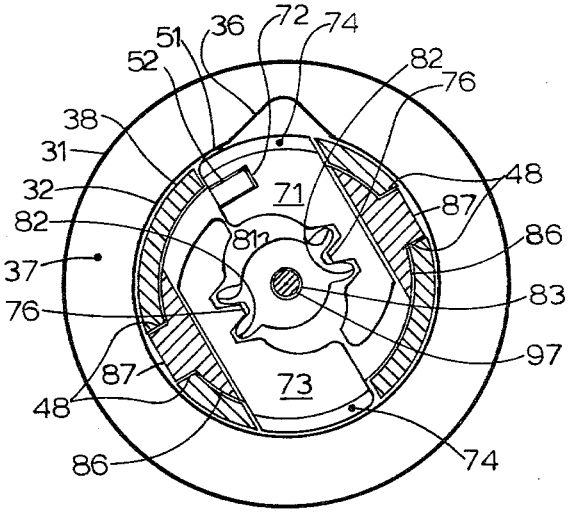
FIG. 22 is a cross sectional view taken along lines 22, 22 of FIG. 1 showing a removable core differential mechanism in an unlocked cylinder and the mechanism disengaged to permit removal of the core assembly.

Both links 71, 73 of FIG. 20 are engaging body rear wall 37 with sidebar 51 in the locked position in locking groove 36. Top link 71 of FIG. 21 has been cammed out of engagement with body rear wall 37 by sidebar 51 having been cammed inwardly out of locking groove 36 during unlocking rotation of core assembly 45 in body 31 with retractor hole 83 being moved out of alignment with hole 89 of spinner 88 while bottom link 73, by reason of its outward bias 78, remains engaged with body rear wall 37. Both links 71, 73 of FIG. 22 are out of engagement with body rear wall 37 with top link 71 being cammed inwardly by sidebar 51 being cammed inwardly out of locking groove 36 during unlocking rotation of core assembly 45 in body 31 with bottom link being withdrawn inwardly by the lever action of cooperating retractor 81 with axle 97 having been inserted through hole 83 thus providing a fixed central pivot for retractor 81.

Figure 13:
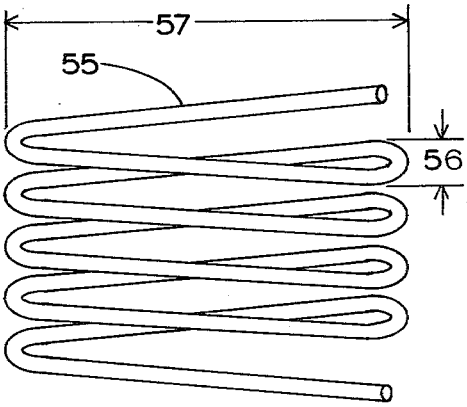
FIG. 13 is an isometric view of a centering spring.

Referring to FIG. 13, centering spring 55 is formed as an elongate helically coiled spring wherein the outside diameter 56 of any bend is of a lesser dimension than the length of the elongate portion 57.

Figure 14:
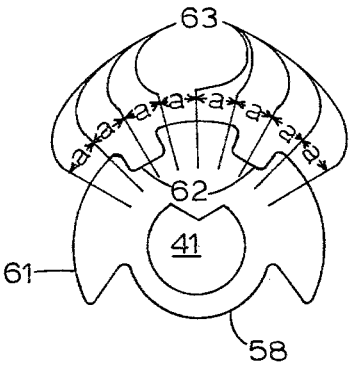
FIG. 14 is a plan view of a rotary disc-tumbler having uniform gating increments.

Rotary disc-tumbler 61 of FIG. 14 has a centrally located keyhole 41, a centering spring recess 58, gatings 62 and gating position centerlines 63 each being a radius of tumbler 61. Gating centerlines 63 having angular increments 'a' therebetween, each increment 'a' being of the same angular value.

Figure 15:
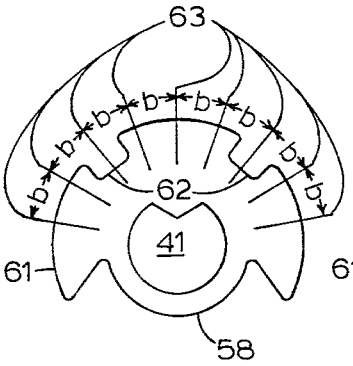
FIG. 15 is a plan view of a rotary disc-tumbler having uniform gating increments.

Rotary disc-tumbler 61 of FIG. 15 has a centrally located keyhole 41, a centering spring recess 58, gatings 62 and gating position centerlines 63 each being a radius of tumbler 61. Gating centerlines 63 having angular increments 'b' therebetween, each increment 'b' being of the same angular value and of a different value than angular increments 'a' of tumbler 61 of FIG. 14.

Figure 16:
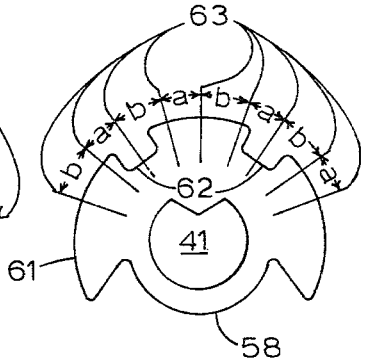
FIG. 16 is a plan view of a rotary disc-tumbler having non-uniform gating increments.

Rotary disc-tumbler 61 of FIG. 16 has a centrally located keyhole 41, a centering spring recess 58, gatings 62 and gating position centerlines 63 each being a radius of tumbler 61. Gating centerlines 63 have angular increments 'a' or 'b' therebetween, increments 'a' being of a different angular value than increments 'b'.

Figure 17:
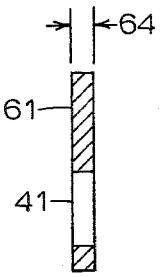
FIG. 17 is a cross section of a rotary disc-tumbler of a given thickness.
Figure 18:
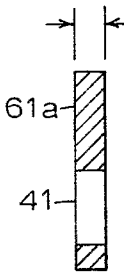
FIG. 18 is a cross section of a rotary disc-tumbler with a thickness differing from the tumbler in FIG. 17.

Rotary disc-tumbler 61, shown in cross section in FIG. 17, is of a thickness 64. Rotary disc-tumbler **61*a*, shown in cross section in FIG. 18, is of a thickness 64*a* being of a greater dimension than thickness 64 in FIG. 17. Rotary disc-tumbler 61*b*, shown in cross section in FIG. 19 is of a thickness 64*b* being of a greater dimension than thickness 64*a* in FIG. 18**.

Figure 19:
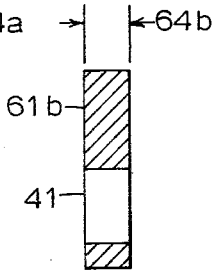
FIG. 19 is a cross section of a rotary disc-tumbler of a thickness differing from the tumblers in FIG. 17 and FIG. 18.

For those practiced in the art, it is evident that spacing variations in the coding of lock cylinder 30 is readily achievable by variations in the thicknesses of spacer elements 59 in the same manner rotary disc-tumblers 61, **61*a* and 61*b* vary in thickness as shown in FIGS. 17, 18 and 19** respectively.

It is understood, obviously, that the particular application for use of this rotary disc-tumbler cylinder is not believed part of the invention nor should it be considered limiting thereto since it is readily evident that the invention can be used in a wide range of applications.

I claim:

1. In a lock cylinder having a body with a generally circular cylindrical opening longitudinally therein, a generally circular cylindrical core assembly selectively removable from and insertable into said body, said core assembly having a flange on one end thereof and being insertable into said body until the rear surface of said flange is in substantial confronting relationship with the face of said body, said body having a generally circular cylindrical counterbore the central axis thereof being coincindental with the central axis of said cylindrical opening, said counterbore being formed part way into said body, the diameter of said counterbore being greater than the diameter of said cylindrical opening and less than the diameter of said flange, said counterbore being formed in said body to provide space for a front sidebar retainer with said core assembly fully inserted in said body.

2. In a lock cylinder according to claim 1 further including a beveled transition between said counterbore and said cylindrical opening, said transition being formed in said body substantially circumferentially around the inside diameter of said body at the conjunction of said counterbore and said cylindrical opening.

3. In a lock cylinder according to claim 1 further including a beveled transition between said counterbore and said face confronted by said flange, said transition being formed in said body substantially circumferentially around the inside diameter of said body at the conjunction of said counter bore and said face confronted by said flange.

4. In a lock cylinder according to claim 1 further including a beveled transition between said counterbore and said cylindrical opening and a beveled transition between said counterbore and said face confronted by said flange, said transitions being formed in said body substantially circumferentially around the inside diameter of said body at the conjunction of said counterbore and said cylindrical opening and at the conjunction of said counterbore and said face confronted by said flange.

5. In a rotary disc-tumbler lock cylinder having a body and a generally circular cylindrical core assembly therein, an elongate sidebar locking element serving to releasably lock said core assembly against rotation relative to said body, a sidebar front retainer encircling the outer circumference of said core assembly, said retainer being yieldingly biased radially inwardly, said retainer serving to contain said sidebar in assembly with said core assembly.

6. In a rotary disc-tumbler lock cylinder having a body and a generally circular cylindrical core assembly therein, an elongate sidebar locking element serving to releasably lock said core assembly against rotation relative to said body, a sidebar front retainer encircling the outer circumference of said core assembly, said retainer being formed of helically coiled wire having a round or other shaped cross section as taken transversely thereof, said retainer being yieldingly biased radially inwardly, said retainer serving to contain said sidebar in assembly with said core assembly.

7. In a rotary disc-tumbler lock cylinder having a body and a generally circular cylindrical core assembly therein, an elongate sidebar locking element serving to releasably lock said core assembly against rotation relative to said body, a sidebar front retainer encircling the outer circumference of said core assembly, said retainer being formed as a substantially circular tubular cylinder, said retainer being yieldingly biased radially inwardly, said retainer serving to contain said sidebar in assembly with said core assembly.

8. In a rotary disc-tumbler lock cylinder having a body and a generally circular cylindrical core assembly therein, said core assembly having a core shell serving as the substantial enclosure thereof, said core shell being formed as a generally circular tubular cylinder with a front face on one end thereof, said front face having a centrally located keyhole therethrough, a core torquing element extending, lengthwise, rearwardly of the rear surface of said front face, said torquing element extending, heightwise, radially inwardly of the inner circumference of said tubular core shell to a depth as measured radially outwardly from the central axis thereof greater than the maximum radius of said keyhole, said torquing element having a width less than the diameter of said keyhole, said torquing element having two contact surfaces, one of said surfaces for torquing said core assembly in a clockwise rotating direction, the other of said surfaces for torquing said core assembly in a counterclockwise rotating direction.

9. In a rotary disc-tumbler lock cylinder having a body and a generally circular cylindrical core assembly therein, said core assembly having a plurality of rotary disc-tumblers therein, said core assembly having a torque tumbler therein, said torque tumbler having a centrally located keyhole therethrough and one or more notches or gatings disposed to extend radially into the periphery thereof, said gating or gatings being disposed angularly from an unlocking position with said torque tumbler in the locked position, said torque tumbler having two torquing drive surfaces disposed to extend radially into the periphery thereof to a depth position as measured radially outwardly from the central axis thereof greater than the maximum radius of said keyhole, one of said drive surfaces serving to torque said core assembly in a clockwise rotating direction, the other of said drive surfaces serving to torque said core assembly in a counterclockwise rotating direction.

10. In a rotary disc-tumbler lock cylinder having a body and a generally circular cylindrical core assembly therein, said body having a generally circular opening therein, said body having one or more elongate locking grooves formed longitudinally along the interior thereof, said core assembly having a core being formed as a generally circular cylinder with a front face of one end thereof, said core having an indexing protrusion opposite the end thereof being formed with said front face, said protrusion extending radially outwardly from the outer circumference of said core, said protrusion being in axial alignment with one of said locking grooves with said core assembly locked against relative rotation with said body, said protrusion extending at the rear of said body beyond confronting relationship with the core assembly axial retaining surface of said body with said core assembly fully inserted into said body, said protrusion being adapted to permit said core assembly to be inserted into said body opening with said protrusion extending into one of said locking grooves, said protrusion being adapted to permit relative rotation of said core assembly with said body with said core assembly fully inserted into said body.

11. In a lock cylinder having a removable core differential mechanism including a body having an opening adapted to receive a removable core assembly therein, said core assembly containing a releasable locking means selectively operable by a key or other means to release said locking means for rotation of said core assembly relative to said body, a plurality of engaging means releasably retaining said core assembly within said body, one of said engaging means being interconnected with said locking means, said locking means serving to cam said inter-connected engaging means out of engagement with said body as said core assembly is rotated out of its rotationally locked position relative to said body, said locking means serving to prevent said inter-connected engaging means from being withdrawn from latching engagement with said body when said locking means is in a position preventing rotation of said core assembly relative to said body.

12. In a lock cylinder according to claim 11 wherein, said inter-connected engaging means being yieldingly biased outwardly of said core assembly provides an outward yielding bias to said locking means.

13. In a lock cylinder according to claim 11 wherein, said inter-connected engaging means being limited in its outward movement of said core assembly limits said locking means in its outward movement of said core assembly serving to retain said locking means in assembly with said core assembly.

14. In a lock cylinder according to claim 11 wherein, said engaging means being partially disposed exterior to the outer circumference of said core assembly when fully extended are formed with a beveled edge along the rear top thereof, said beveled edges serving to displace said engaging means chordally inwardly during insertion of said core assembly in said body.

15. In a lock cylinder having a body and a generally circular cylindrical core assembly therein, a removable core differential mechanism having a plurality of engaging means releasably retaining said core assembly within said body, said engaging means being yieldingly biased chordally outwardly of said core assembly, a retractor means cooperating with each of said engaging means, said yielding bias of said engaging means being transmitted thereto through said retractor means, said retractor means being torsionally yieldingly biased.

16. In a rotary disc-tumbler lock cylinder having a body and a generally circular cylindrical core assembly therein, said core assembly having a plurality of rotary disc-tumblers therein, each of said tumblers being formed with one or more notches or gatings randomly disposed to extend radially into the periphery thereof, a centering spring serving to yieldingly bias said tumblers to scramble said gatings in the locked condition of said cylinder, said centering spring being formed of wire having a round or other cross section taken transversely thereof, said wire being formed in one or more oblong shaped cylindrical helical coils, each of said helical coils taken transversely thereof having a greater length than width.

17. In a rotary disc-tumbler lock cylinder having a body and a generally circular cylindrical core assembly therein, said core assembly having a plurality of rotary disc-tumblers therein, each of said tumblers having a centrally located keyhole therethrough, each of said tumblers being formed with a centering spring recess disposed to extend radially into the periphery thereof arcuately equidistant from the vertical centerline of said tumblers opposite the edge of said tumblers that are disposed under a locking sidebar element in the neutral or locked condition of said cylinder, each of said tumblers being formed with one or more notches or gatings disposed to extend radially into the periphery thereof, said gatings being formable in each of said tumblers in a plurality of positions, the centerlines of each of said positions being radii of said tumblers, said centerlines taken consecutively in each of said tumblers having a constant angular increment one to the other, said angular increments in at least one of said tumblers being of a different angle than said angular increments of other of said tumblers in the same said core assembly.

18. In a rotary disc-tumbler lock cylinder having a body and a generally circular cylindrical core assembly therein, said core assembly having a plurality of rotary disc-tumblers therein, each of said tumblers having a centrally located keyhole therethrough, each of said tumblers being formed with a centering spring recess disposed to extend radially into the periphery thereof arcuately equidistant from the vertical centerline of said tumblers opposite the edge of said tumblers that are disposed under a locking sidebar element in the neutral or locked condition of said cylinder, each of said tumblers being formed with one or more notches or gatings disposed to extend radially into the periphery thereof, said gatings being formable in each of said tumblers in a plurality of positions, the centerlines of each of said positions being radii of said tumblers, the angular incrementation as between at least one pair of said centerlines taken consecutively in at least one of said tumblers differing from other angular incrementations as between other pairs of centerlines taken consecutively in the same said tumbler.

19. In a rotary disc-tumbler lock cylinder having a body and a generally circular cylindrical core assembly therein, said core assembly having a plurality of rotary disc-tumblers therein, each of said tumblers being formed with a centering spring recess disposed to extend radially into the periphery thereof arcuately equidistant from the vertical centerline of said tumbler opposite the edge of said tumblers that are disposed under a locking sidebar element in the neutral or locked condition of said cylinder, one or more of said tumblers having a thickness differing from other of said tumblers in said core assembly.

20. A rotary disc-tumbler lock cylinder having a body and a generally circular cylindrical core assembly therein, said core assembly having a core shell, a torque tumbler, a centering spring, an elongate sidebar, a sidebar front retainer, a removable core differential mechanism, said core assembly being selectively rotationally releasably lockable relative to said body by a key or other means, said core shell serving as the substantial enclosure of said core assembly, said core shell being formed as a generally circular tubular cylinder with a flanged face on one end thereof and the opposite end thereof being open, said body having a generally circular cylindrical opening therein, said body having a generally circular cylindrical counterbore the central axis thereof being coincindental with the central axis of said cylindrical opening, said counterbore being formed longitudinally part way into said body, the diameter of said counterbore being greater than the diameter of said cylindrical opening and less than the diameter of said flanged face of said core shell, said sidebar front retainer being yieldingly biased radially inwardly when encircling said core assembly, said sidebar front retainer serving to contain said sidebar in assembly with said core assembly, said removable core differential mechanism having a plurality of engaging means releasably retaining said core assembly within said body, one of said engaging means being inter-connected with said sidebar, said sidebar serving to cam said inter-connected engaging means out of engagement with said body as said core assembly is rotated out of its rotationally locked position in said body, said sidebar serving to prevent said inter-connected means from being withdrawn from latching engagement with said body when said sidebar is in a position preventing rotation of said bore assembly relative to said body, said core shell having an indexing protrusion opposite the end thereof formed with said flanged face, said protrusion extending radially outwardly from the outer circumference of said core shell, said protrusion being adapted to pass through a locking groove formed longitudinally along the interior of said body during insertion of said core assembly in said body, said protrusion being adapted to permit relative rotation of said core assembly with said body.

21. A lock cylinder in accordance with claim 20 wherein, said core having a core torquing element extending, lengthwise, rearwardly of the rear surface of said flanged face, said torquing element extending, lengthwise, radially inwardly of the inner circumference of said tubular core shell to a depth as measured outwardly from the central axis thereof greater than the maximum radius of a keyhole formed through said flanged face along the central axis thereof, said torquing element having a width less than the diameter of said keyhole, said torquing element having two contact surfaces, one of said surfaces for torquing said core assembly in a clockwise rotating direction, the other of said surfaces for torquing said core assembly in a counterclockwise rotating direction.

22. In a rotary disc-tumbler lock cylinder according to claim 20 wherein, said torque tumbler having a centrally located keyhole therethrough and one or more notches or gatings disposed to extend radially into the periphery thereof, said gating or gatings being disposed anguarly from an unlocking position with said torquing tumbler in the locked position, said torque member having two torquing drive surfaces disposed to extend radially into the periphery thereof to a depth position as measured radially outwardly from the central axis thereof greater than the maximum radius of said keyhole, one on said drive surfaces serving to torque said core assembly in a clockwise rotating direction, the other of said drive surfaces serving to torque said core assembly in a counterclockwise rotating direction.

23. In a rotary disc-tumbler lock cylinder according to claim 20 wherein, said centering spring being formed of wire having a round or other cross section taken transversely thereof, said wire being formed in one or more elongate helical coils, said elongate portion of each of said coils being of a dimension greater than the outside diameter of any bend of said coils.

24. A rotary disc-tumbler lock cylinder having a body and a generally circular cylindrical core assembly therein, said core assembly consisting of a core shell, a plurality of rotary disc-tumblers each being formed with a centrally located keyhole therethrough and with one or more notches or gatings disposed to extend radially into the periphery thereof, a plurality of spacer elements, a torque tumbler, a removable core differential mechanism, a centering spring, an elongate sidebar locking element, a sidebar front retainer, a driver bar, a driver disc and a retaining ring, said core assembly being selectively rotationally releasably lockable relative to said body by a key or other means, said core shell serving as the substantial enclosure of said core assembly, said core shell being formed as a generally circular tubular cylinder with a flanged face on one end thereof and the opposite end thereof being open, said core assembly being insertable into said body until the rear surface of said flange is in substantial confronting relationship with the face of said body, said flanged face having a centrally located keyhole therethrough, said body having a generally circular cylindrical opening therethrough, said body having one or more elongate locking grooves formed longitudinally along the interior thereof, said body having a generally circular cylindrical counterbore the central axis thereof being coincidental with the central axis of said cylindrical opening, said counterbore being formed part way into said body, the diameter of said counterbore being greater than the diameter of said cylindrical opening and less than the diameter of said flanged face, said sidebar front retainer being yieldingly biased radially inwardly when encircling said core assembly, said sidebar front retainer serving to contain said sidebar in assembly with said core assembly, said core shell having a core torquing element extending, lengthwise, rearwardly of the rear surface of said flanged face, said torquing element extending, heightwise, radially inwardly of the inner circumference of said tubular core shell to a depth as measured outwardly from the central axis thereof greater than the maximum radius of said keyhole, said torquing element having a width less than the diameter of said keyhole, said torquing element having two contact surfaces, one of said surfaces for torquing said core assembly in a clockwise rotating direction, the other of said surfaces for torquing said core assembly in a counterclockwise rotating direction, said torque tumbler having a centrally located keyhole therethrough and one or more notches or gatings disposed to extend radially into the periphery thereof, said gating or gatings being disposed angularly from an unlocking position with said torque tumbler in the locked position, said torque tumbler having two torquing drive surfaces disposed to extend radially into the periphery thereof to a depth position as measured radially outwardly from the central axis thereof greater than the maximum radius of said keyhole, one of said drive surfaces serving to torque said core assembly in a clockwise rotating direction, the other of said drive surfaces serving to torque said core assembly in a counterclockwise rotating direction, said core shell having an indexing protrusion opposite the end thereof formed with said flanged face, and protrusion extending radially outwardly from the outer circumference of said core shell, said protrusion being adapted to pass through said locking groove in said body during insertion of said core assembly in said body, said protrusion being adapted to permit relative rotation of said core assembly with said body, said removable core differential mechanism having a plurality of engaging means releasably retaining said core assembly within said body, one of said engaging means being inter-connected with said sidebar, said sidebar serving to cam said inter-connected engaging means out of engagement with said body as said core assembly is rotated out of its rotationally locked position in said body, said sidebar serving to prevent said inter-connected engaging means from being withdrawn from latching engagement with said body said sidebar is in a position preventing rotation of said core assembly relative to said body, said centering spring being formed of wire having a round or other cross section taken transversely thereof, said wire being formed in one or more elongate helical coils, the elongate portion of each of said coils being of a dimension greater than the outside diameter of any bend of said coils, said centering spring serving to yieldingly bias said rotary disc-tumblers and said torque tumbler to positions to form a central unobstructed keyhole therethrough.

25. In rotary disc-tumbler lock cylinder according to claim 24 further including a beveled transition between said counterbore and said cylindrical opening of said body.

26. In a rotary disc-tumbler lock cylinder according to claim 24 further including a beveled transition between said counterbore and said face of said body confronting said flange.

27. In a rotary disc-tumbler lock cylinder according to claim 24 further including a beveled transition between said counterbore and said cylindrical opening, and a beveled transition between said counterbore and said face of said body confronting said flange.

28. In a rotary disc-tumbler lock cylinder according to claim 24 wherein, said sidebar retainer is formed of helically coiled wire, said wire having a round or other shaped cross section taken transversely thereof.

29. In a rotary disc-tumbler lock cylinder according to claim 24 wherein, said sidebar retainer is formed as a substantially circular tubular cylinder.

30. In a rotary disc-tumbler lock cylinder according to claim 24 wherein, said gatings of said rotary disc-tumblers being formable in each of said tumblers in one or more of a plurality of positions, the centerlines of each of said positions being radii of said tumblers, said centerlines taken consecutively in each of said tumblers having a constant angular increment one to the other, said angular increments in at least one of said tumblers being of a different angle than said angular increments of other of said tumblers in the same said core assembly.

31. In a rotary disc-tumbler lock cylinder according to claim 24 wherein, said gatings of said rotary disc-tumblers being formable in each of said tumblers in one or more of a plurality of positions, the centerlines of each of said positions being radii of said tumblers, the angular incrementation as between at least one pair of said centerlines taken consecutively in at least one of said tumblers differing from the other angular incrementations as between other pairs of said centerlines taken consecutively in the same said tumbler.

32. In a rotary disc-tumbler lock cylinder according to claim 24 wherein, one or more of said rotary disc-tumblers having a thickness differing from others of said tumblers in said core assembly.

33. In a rotary disc-tumbler lock cylinder according to claim 24 wherein, said rotary disc-tumblers being separated one from the other by one or more of said spacer elements therebetween, one or more of said spacer elements having a thickness differing from others of said spacer elements in said core assembly.

* * * * *